United States Patent [19]

Troutner

[11] 4,033,166

[45] July 5, 1977

[54] SEQUENCING DIE AND METHOD FOR FORMING TRUSS WEBS FROM METAL TUBING

[75] Inventor: Arthur L. Troutner, Boise, Idaho

[73] Assignee: Trus Joist Corporation, Boise, Idaho

[22] Filed: Jan. 2, 1976

[21] Appl. No.: 646,043

[52] U.S. Cl. ..... 72/334; 72/367

[51] Int. Cl.[2] ..... B21D 28/06; B21D 28/04; B21D 28/26; B21D 43/26

[58] Field of Search ..... 72/36, 313, 327, 331, 72/334, 397, 427, 367

[56] References Cited

UNITED STATES PATENTS

| | | | |
|---|---|---|---|
| 1,144,281 | 6/1915 | Andrews | 72/334 |
| 1,849,669 | 3/1932 | Glasner et al. | 72/334 |
| 2,838,111 | 6/1958 | Baltus | 72/331 X |
| 2,844,204 | 7/1958 | Beebee | 72/334 |
| 3,260,087 | 7/1966 | Guarino | 72/36 |
| 3,263,465 | 8/1966 | Way et al. | 72/331 X |
| 3,436,949 | 4/1969 | Halstead et al. | 72/427 X |

*Primary Examiner*—Othell M. Simpson
*Assistant Examiner*—Horace M. Culver
*Attorney, Agent, or Firm*—Eugene D. Farley

[57] ABSTRACT

A sequencing die and method for forming truss webs or links from metal tubing includes as a first step providing a continuous length of tubing to a die assembly operably engaged by a mechanical press wherein the end portion of the tubing is flattened by flattening means to form a first flattened web end. Sequentially following without any further flattening the web end is punched by punching means located in the flattening means to form a cross pin receiving hole and a terminal end portion. The tubing is then advanced in the die assembly whereupon it is again flattened and punched sequentially by the flattening and punching means respectively to form a second web end.

Gripping means located on the sequencing die outwardly adjacent the die assembly grip the tubing during the forming of the webs. They are configured for movement relative to the die assembly to allow lateral displacement of the tubing during flattening aligning the web ends with the longitudinal centerline of the tubing.

Indexing means allows longitudinal indexing of the first web end relative to the die assembly allowing accurate separation of the second web end for consistent predetermined web lengths. It includes antitwisting means to prevent angular twisting of the web ends relative one another during forming.

9 Claims, 28 Drawing Figures

SEQUENCING DIE AND METHOD FOR FORMING TRUSS WEBS FROM METAL TUBING

BACKGROUND OF THE INVENTION

This invention relates to a sequencing die and method for forming truss webs or links from metal tubing.

Composite truss joists comprising spaced, elongate wood chords interengaged by metal webbing, such as shown in my prior U.S. Pat. No. 3,137,899, have become widely used in many types of structural applications. The webs used in these trusses generally are formed from metal tubing and comprise a medial tubular portion with flattened web ends at each extremity defining a central cross pin receiving hole.

Heretofore, the apparatus for forming these webs have formed webs with margins between the flattened web ends and the medial portions of the webs which are substantially normal to the longitudinal axes of the webs. Thus when the webs are positioned between the chords, portions of the flattened web ends necessarily are unsupported by the chords. These unsupported portions are subject to easy bending when compressive forces are transmitted through the webs. To overcome this weakness prior art webs have formed from tubing that was larger than otherwise required, thus increasing the weight and cost of the truss.

In addition the prior web forming apparatus have not flattended the web ends completely before initiating punching of the cross pin receiving holes and shearing of the terminal portions. Thus the web ends are never completely flattened due to interference from the punch. Conversely the web ends interfere with the punch causing difficulty in stripping the punch and increased punch wear. This also causes the holes to be formed slightly elliptical with jagged edges and not centered accurately laterally in the web ends, nor located accurately relative to their terminal portions. Therefore, the cross pins do not fit tightly in their holes, resulting in wear of the pins and causing dimensionally inaccurate trusses.

Furthermore, the prior web forming apparatus flatten the web ends while supporting the medial portions of the webs rigidly, thus causing the web ends to be laterally displaced and thus offset from the longitudinal center line of the webs.

Accordingly, it is the principal object of the present invention to provide a sequencing die for forming truss joist webs which flattens the web ends completely before initiating punching of the crosspin receiving holes and trimming their terminal portions.

It is a further object of the present invention to provide a sequencing die for forming truss joist webs having means to form diagonal chard-supporting margins between the web ends and the medial portions of the webs.

It is a further object of the present invention to provide a sequencing die for forming truss joist webs having means to form opposed triangular semiflattened portions on both sides of the web ends adjacent the margins between the web ends and the medial portions of the webs.

It is a further object of the present invention to provide a sequencing die for forming truss joist webs having gripping means configured to support the webs during flattening of the webs in a manner allowing gradual lateral displacement of the webs proportional to the amount of flattening, thus forming web ends which are aligned with the longitudinal center line of the webs.

It is a further object of the present invention to provide a sequencing die for forming truss joist webs having indexing means to index the webs longitudinally relative to the die assembly to form dimensionally accurate web lengths.

It is a further object of the present invention to provide a sequencing die for forming truss joist webs having antitwisting means associated with the indexing means to allow indexing the webs during forming in a manner giving angularly aligned web ends.

It is a further object of the present invention to provide a sequencing die for forming truss joist webs of different diameters and wall thicknesses.

It is a further object of the present invention to provide a sequencing die for forming truss joist webs having means to punch cross pin receiving holes of different diameters in the web ends of different webs, or in opposed web ends of the same web.

THE DRAWINGS

The manner in which the foregoing and other objects of the invention are accomplished will be apparent from the accompanying specification and claims, considered together with the drawings wherein:

GENERAL STATEMENT OF THE INVENTION

The sequencing die of my invention is engaged operably by a mechanical press for forming a truss web from a continuous length of tubing. The sequencing die broadly comprises flattening means configured for forming flattened end portions at each extremity of the web. After the end portion is completely flattened, punching means located in the flattening means punches a cross pin receiving hole and shears a terminal end portion in the flattened web and without further flattening. Thus the punching means does not interfere with the flattening and completely flattened end portions are formed with accurately located circular holes.

DETAILED DESCRIPTION OF A PREFERRED EMBODIMENT

Figure 1:
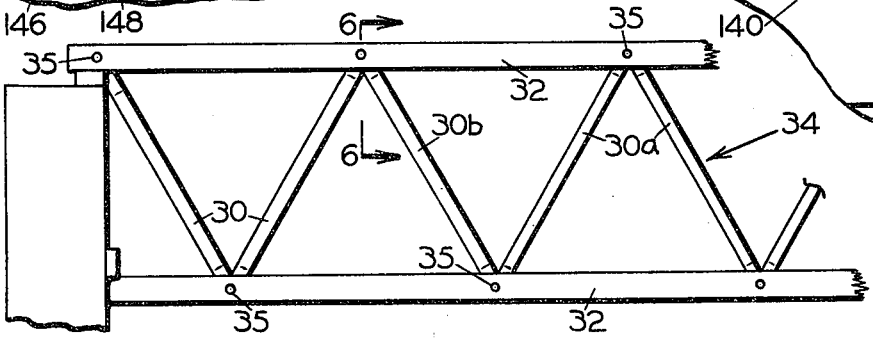
FIG. 1 is a fragmentary view in elevation of a truss incorporating webs formed by the sequencing die of the present invention in a typical webbing pattern.

The sequencing die and method of the present invention is intended for forming a web 30 for use in composite truss joists having wooden chords 32 interconnected by metal webbing 34 and cross pins 35, FIG. 1.

Referring to FIGS. 2–7 the web formed by the sequencing die includes an elongate tubular medial portion 36 with a generally planar web end 38 integrally joined to each extremity. The web ends comprise flattened end portions 40 having arcuate terminal portions 42 and medially located cross pin receiving holes 44.

Figures 2, 3, 4, 5, 8, 16, 17, 18:
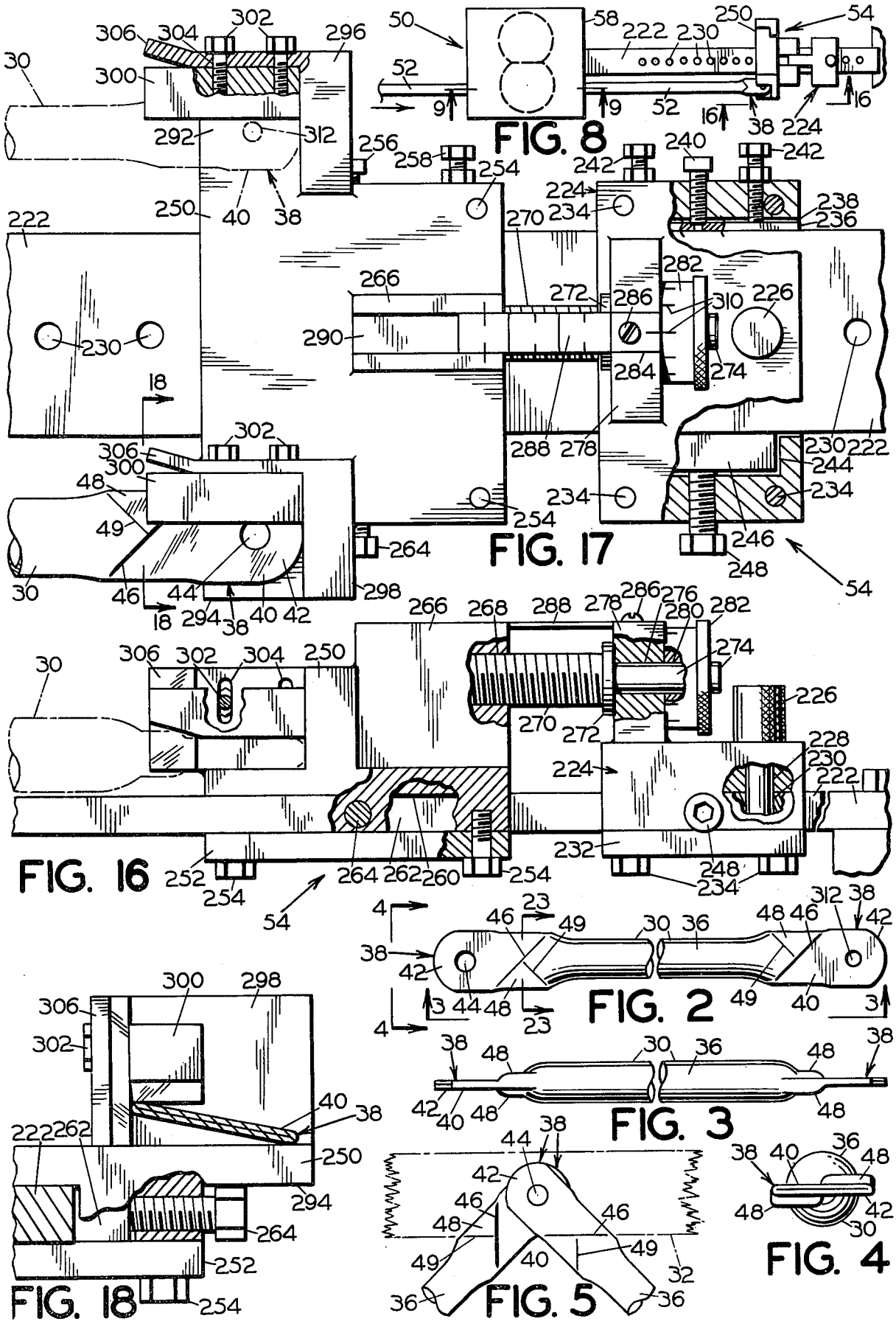
FIG. 2 is a foreshortened, longitudinal view in plan of a web formed by the sequencing die.
FIG. 3 is a foreshortened view in side elevation taken along line 3—3 of FIG. 2.
FIG. 4 is a view in end elevation taken along line 4—4 of FIG. 2.
FIG. 5 is an enlarged, fragmentary view in elevation of a typical truss joint utilizing the webs with the truss chord illustrated in broken lines.
FIG. 8 is a diagrammatic view in plan of the sequencing die of the present invention.
FIG. 16 is an enlarged, fragmentary view in elevation taken along line 16—16 of FIG. 8 showing the indexing means which is a component of the sequencing die, partially broken away for convenience of illustration.
FIG. 17 is a fragmentary view in plan of the indexing means of FIG. 16, partially broken away for convenience of illustration.
FIG. 18 is a fragmentary, enlarged, cross sectional view taken along line 18—18 of FIG. 17 partially broken away for convenience of illustration.

The margins formed between the flattened end portions and the medial portion of the web preferably are diagonal, as shown by lines 46 in FIG. 2. Immediately adjacent the diagonal margins are triangular shaped, partially flattened portions 48 defined by lines 46 and 49. The apparatus is configured to form the diagonal margins and partially flattened portions oppositely at each end and at the top and bottom of the web to provide supporting edges for adjacent chords 32.

Referring now to FIG. 8, the apparatus generally comprises a die assembly 50 for forming the web ends from a continuous length of tubing 52, including gripping means 187 located within the die assembly to grip the tubing during the forming and indexing means 54 separated from the die head by an adjustably selected distance to allow forming a web of accurately predetermined length.

THE DIE ASSEMBLY

Figures 7, 10:
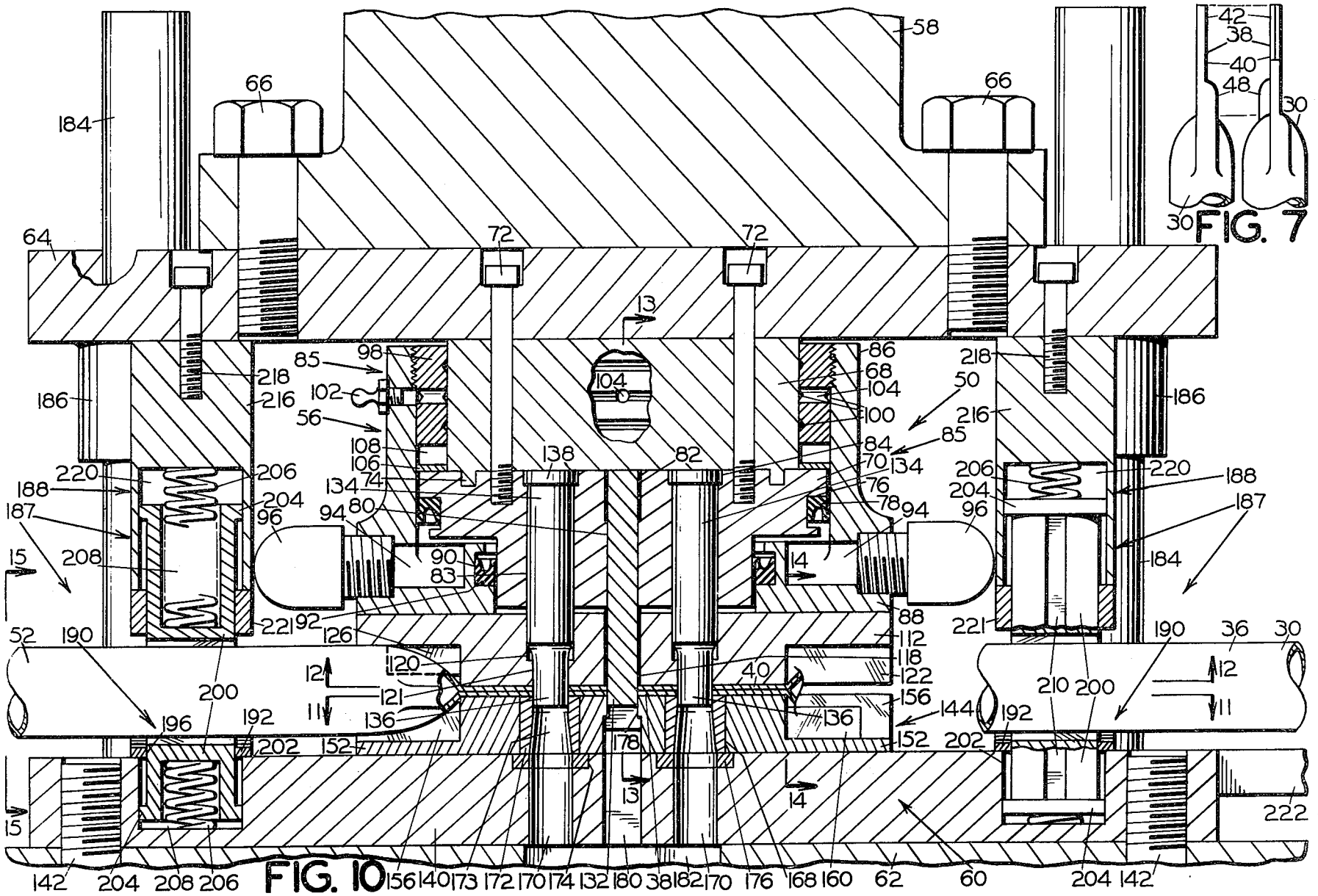
FIG. 7 is an exploded, fragmentary view in elevation relating to FIG. 6 with all parts except the webs being omitted.
FIG. 10 is a view similar to that of FIG. 9 except that the die assembly is shown in its closed position.
Figure 14:
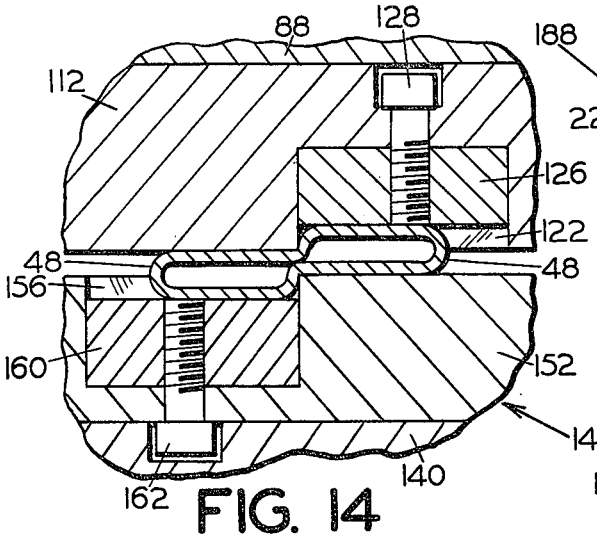
FIG. 14 is an enlarged, fragmentary, cross sectional view taken along line 14—14 of FIG. 10.
Figure 15:
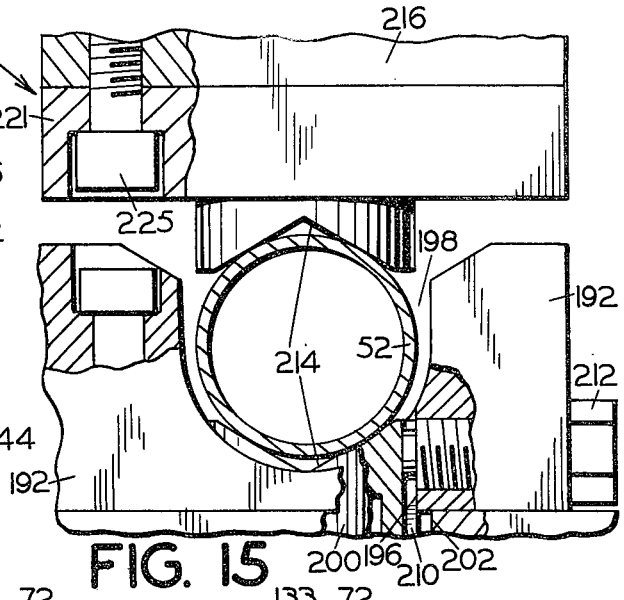
FIG. 15 is an enlarged, fragmentary, cross sectional view taken along line 15—15 of FIG. 10, partially broken away for convenience of illustration.
Figure 9:
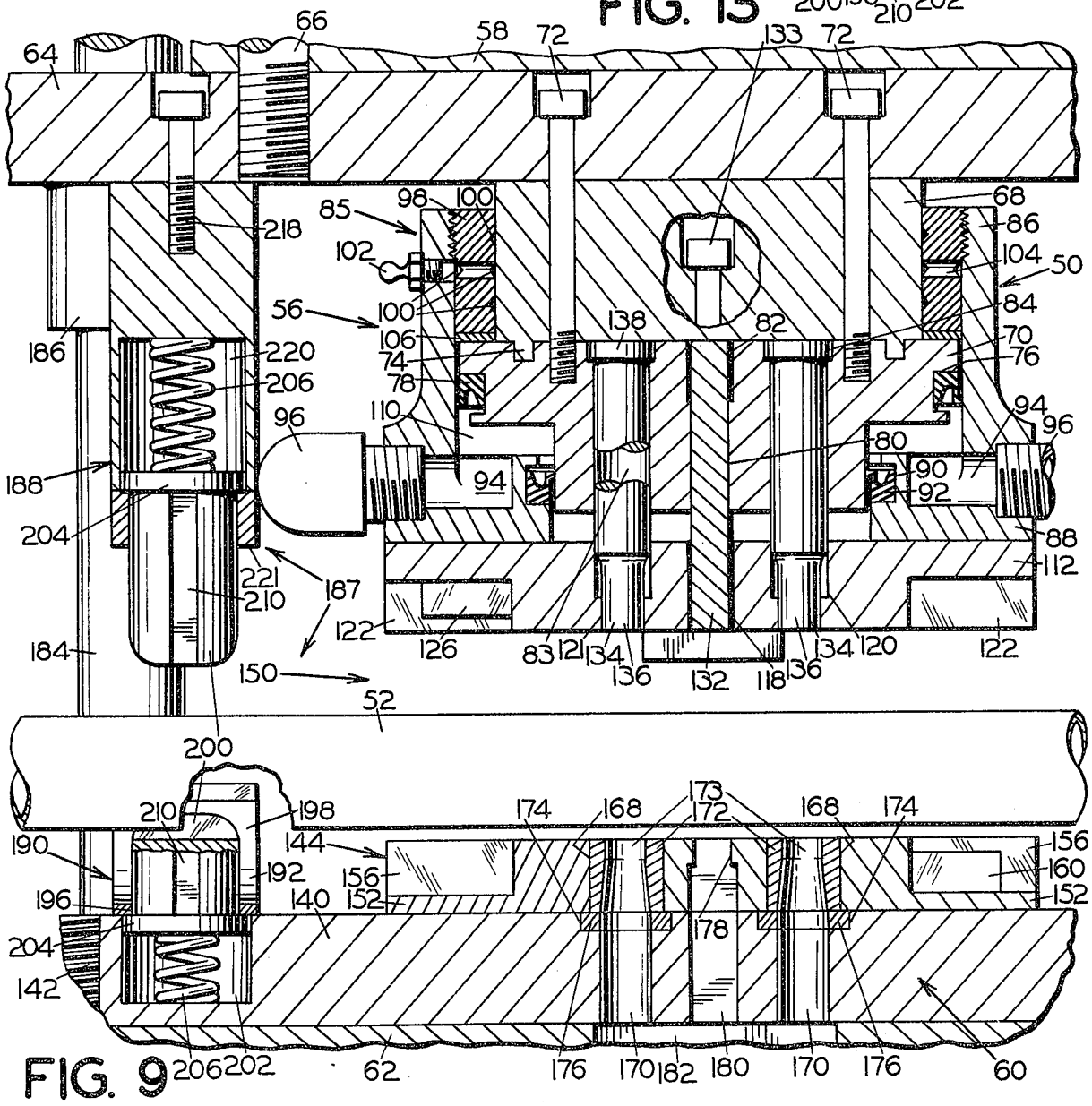
FIG. 9 is an enlarged, fragmentary, cross sectional view taken along line 9—9 of FIG. 8, showing the die assembly of the sequencing die in its open position partially broken away for convenience of illustration.
Figure 23:
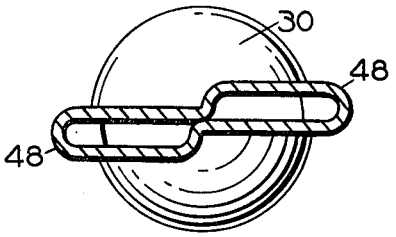
FIG. 23 is a cross sectional view taken along line 23—23 of FIG. 2.

The die assembly 50 is shown in an open, tubing-receiving position in FIG. 9 and a closed, forming position in FIG. 10. The die assembly preferably includes two upper dies 56 which are attached to the movable ram 58 of a commercially available mechanical press, and two lower dies 60 which are attached to the stationary bolster plate 62 of the press.

Figure 11:
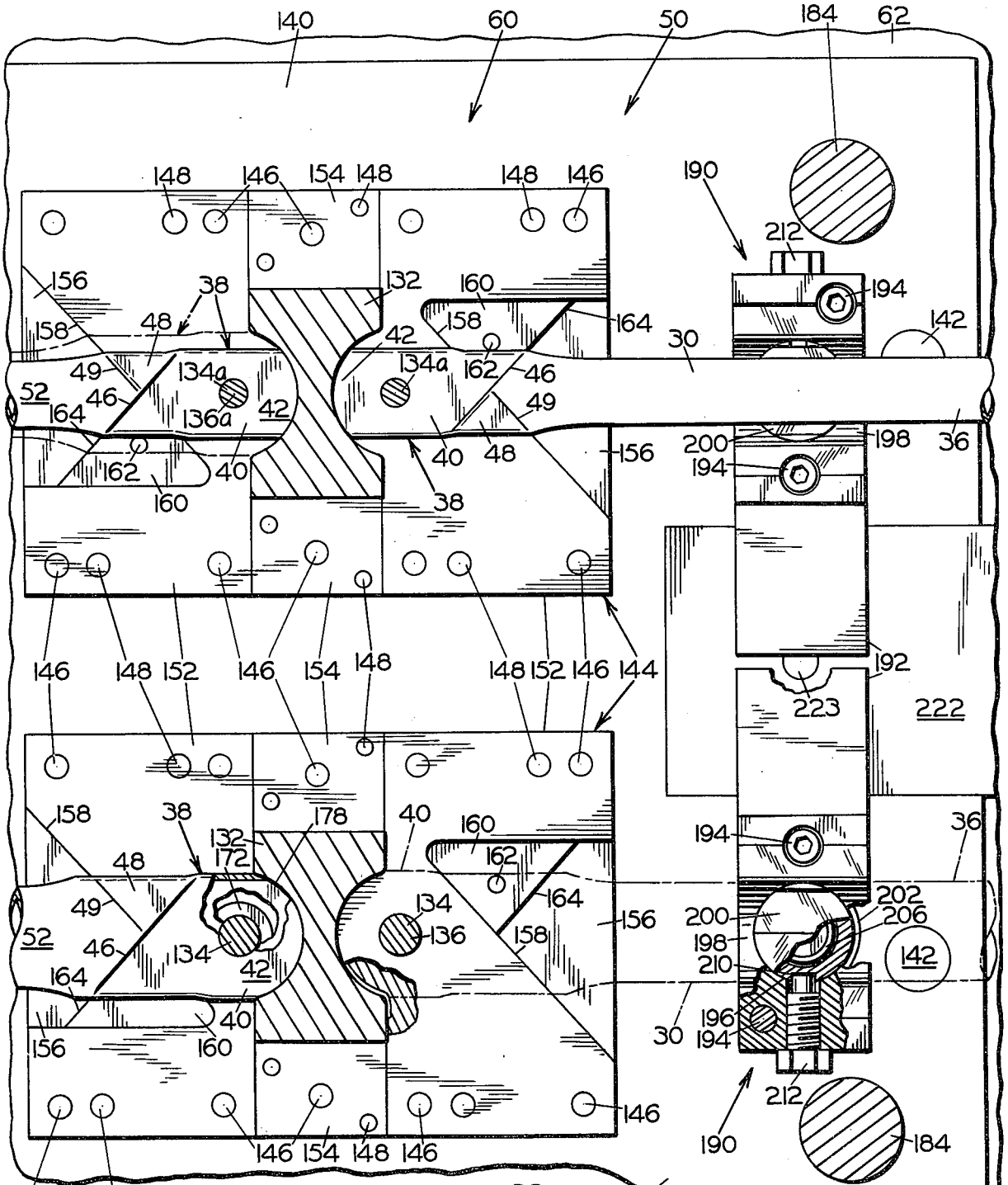
FIG. 11 is a fragmentary, cross sectional view in plan, taken along line 11—11 of FIG. 10, partially broken away for convenience of illustration.

Top shoe 64, FIGS. 9, 10 and 11, comprises a rectangular plate which is secured to the ram 58 by means of bolts 66 and mounts the various elements of the upper dies. Cylindrical punch pads 68 are located inwardly, or toward the tubing, of the inner surface of the top shoe. Punch holders 70 are located inwardly adjacent the punch pads and secure the punch pads to the top shoe by means of bolts 72 which pass through bores located in the punch pads and engage threaded bores in the punch holders. Annular rings 74 extend from the punch pads into mating grooves in the punch holders to align them radially relative one another.

The punch holders comprise outer cylindrical portions having diameters slightly greater than the diameters of the punch pads and inner cylindrical portions integral therewith having diameters slightly smaller than the diameters of the punch pads. The periphery of the outer cylindrical portions defines seal grooves 76 containing seals 78.

Figure 12:
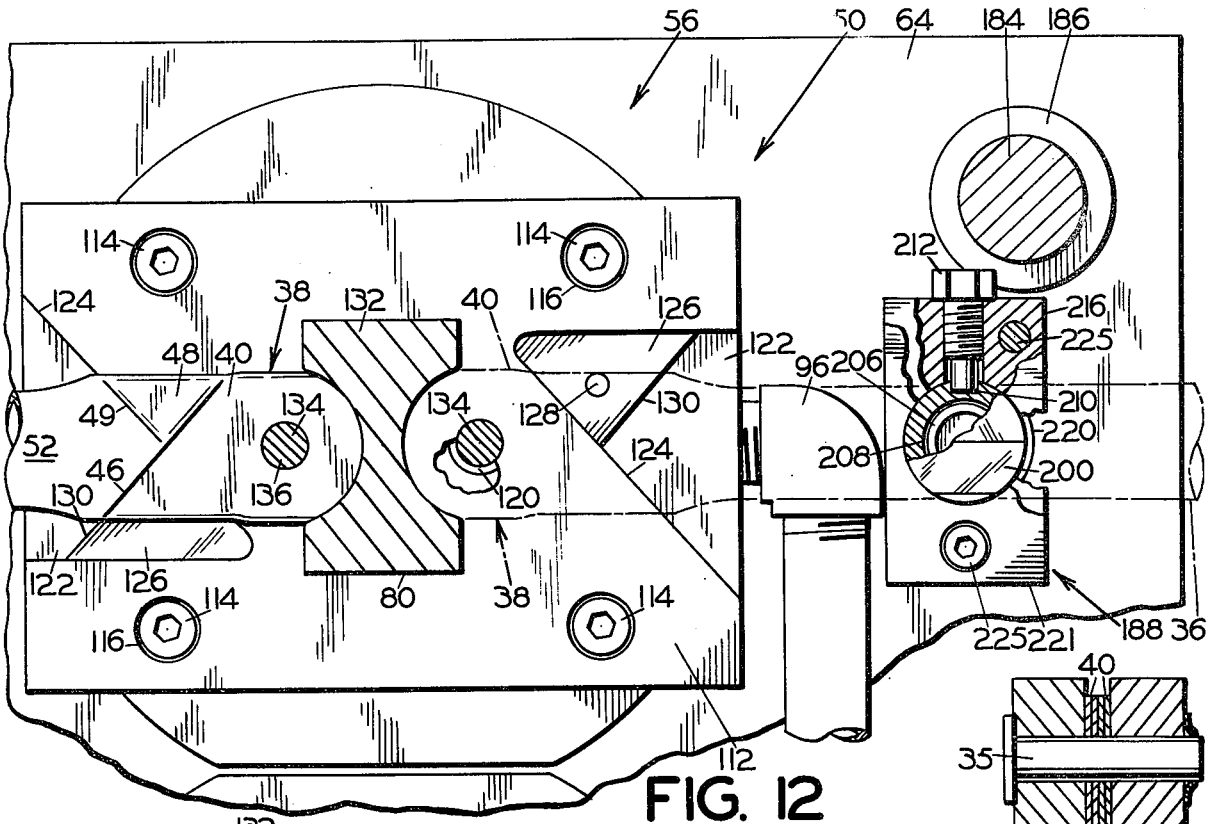
FIG. 12 is a fragmentary, cross sectional view in inverted plan taken along line 12—12 of FIG. 10, partially broken away for convenience of illustration.

Generally I shaped shear openings 80, FIG. 12, having arcuate sides are located through the medial portions of the punch holders 70. The outer portions of the openings are relieved slightly around their peripheries 82.

Substantially centered in the arcuate sides of the shear openings are punch bores 83 which pass through the punch holders. Shallow counter bores 84 are located coaxial with the punch bores adjacent to the outer surfaces of the punch holders.

Cylindrical L-shaped sleeves 85 slidably fit over the outer cylindrical portions of punch holders 70. The sleeves comprise outer legs 86 having radially inner diameters sligthly larger than the radially outer diameters of the outer cylindrical portions of the punch holders and having radially inwardly facing threads at their outer extremities. The inner legs 88 of sleeves 84 have radially inner diameters slightly larger than the radially outer diameters of the inner cylindrical portions of the punch holders, and include seal grooves 90 containing seals 92.

Threaded bores 94 are located radially in the sleeves at a position such that they partially intersect the outer surfaces of the inner legs. Hydraulic fittings 96 are inserted into the bores.

Annular bushings 98 are located in the outer portions of the open areas between the outer legs 86 of the sleeves 85 and the punch pads 68. The bushings are joined to the sleeves by threads which mate with the threads of the sleeves. Radial lubrication grooves 100 are located on both sides of the bushings to contain lubricant passed from grease fittings 102 located in the sleeves in openings 104.

Annular leather shock rings 106 are located adjacent the punch holders in the remaining open areas 108 between the bushings 98 and the punch pads 68.

The bushings are dimensioned to allow sliding motion of the sleeves relative to the punch holders between flattening positions, shown in FIG. 9, and punching positions, shown in FIG. 10. Thus annular passageways 11 sealed by seals 78 and 90 and opening into bores 94 are formed when the sleeves are in their flattening positions.

Thin rectangular stamping heads 112, FIG. 12, are joined to the inner legs 88 of sleeves 85 by means of bolts 114. Counter bores 116 are located in the stamping heads to locate the heads of the bolts below the surfaces of the stamping heads. Shear openings 118 and punch bores 120 are located in the stamping heads in alignment with the shear openings 80 and punch bores 83 of the punch holders. The outer portions of the punch bores 121 have smaller diameters than their inner portions.

Triangular shaped recesses 122 are located at each end of the inner surfaces of the stamping heads with their apexes facing toward the shear openings. The recesses have bases which are considerably wider than the width of the tubing 52. They are oriented to present edges 124 diagonally intersecting the tubing. The recesses are positioned so that their diagonal edges are oppositely oriented at each end of the stamping heads. The depths of the recesses are sufficient to allow passage of the upper portion of the tubing without any flattening, thus forming the diagonal margins 46 between the flattened end portions and the medial portion of the tubing.

Triangular die blocks 126 are mounted in the apex ends of the recesses by means of screws 128. The die blocks are oriented in a manner to present diagonal edges 130 across the longitudinal centers of the recesses substantially normal to the diagonal edges 124 of the recesses. The die blocks are of a thickness such that they do not fill the recesses completely thus forming the triangular partially flattened portions 48 of the web ends.

Figure 13:
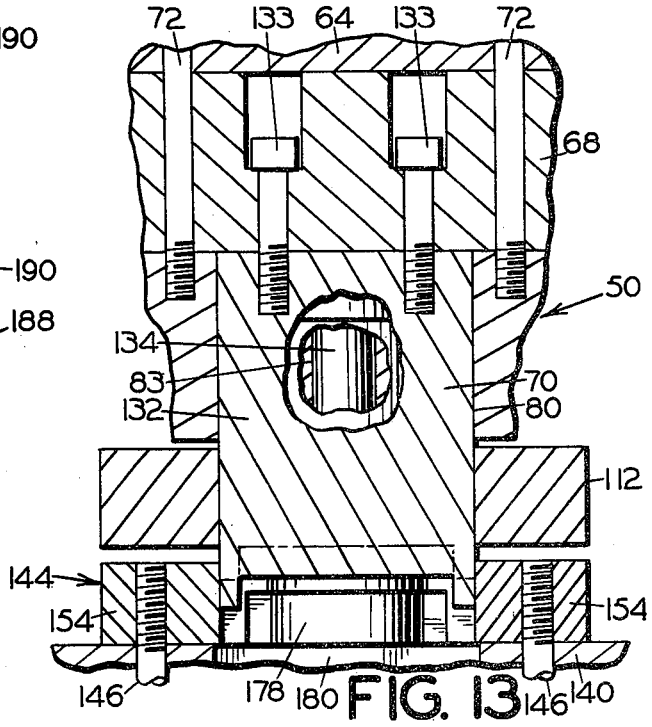
FIG. 13 is a fragmentary, cross sectional view taken along line 13—13 of FIG. 10, partially broken away for convenience of illustration.
Figure 28:
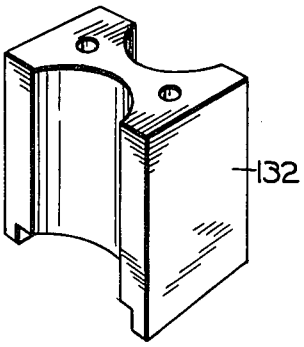
FIG. 28 is a perspective view showing the novel shear which is used in the sequencing die.

Punching means comprises I shaped shears 132 and cylindrical punches 134. The shears 132, FIG. 28, have arcuate cutting edges on each of their sides to fit slidably within shear openings 80 and 118 in the punch holders and stamping heads respectively. The fit between the central portions of the punch holders and the shears has close tolerances to assure normal travel of the shears relative to the stamping heads. As shown in FIG. 13, the shears are joined to the punch pads 68 by means of bolts 133.

Cylindrical punches 134 having inwardly facing reduced diameter cutting portions 136 and outwardly facing enlarged heads 138 slidably fit within the punch bores 83 and 121 in the punch holders and stamping heads respectively. The diameters of the punches also allow close tolerance fits in their respective bores with their heads configured to fit within counterbores 84.

The shear and punches have lengths that position their inner ends coplanar with the inner surfaces of the stamping heads when the punch holders are in their flattening positions.

The lower dies 60, shown in FIGS. 9, 10 and 11, are mounted to the press by means of a thin, rectangular die shoe 140 which is attached to bolster plate 62 by means of bolts 142. Die matrixes 144 are attached to the die shoe by means of bolts 146 and are aligned by pins 148. The die matrixes are configured to mate with the stamping heads 112, together forming the flattening means 150 of the apparatus. In the embodiment illustrated, each die matrix is divided into two side elements 152 separated by paired spacers 154 to facilitate machining.

The die matrixes include recesses 156 on their inner surfaces similar to the recesses 122 in the stamping heads. However, the recesses 156 are reversed from their mating recesses 122 presenting diagonal edges 158 substantially normal to mating edges 124. Triangular die blocks 160 are mounted in recesses 156 by means of bolts 162. The die blocks again are thinner than the recesses and are oriented to present diagonal edges 164 substantially normal to edges 158 of the recesses.

Punch openings 168 and 170 are located in the die matrixes and the die shoe respectively in alignment with punches 134. The punch openings 168 in the die are of diameters larger than the diameters of the punches and have cylindrical matrix bushings 172 pressed therein. The matrix bushings have bores 173 configured at their inner portions to receive the punches. The bores flare outwardly slightly at their outer portions to facilitate ejection of the slugs removed by the punches.

The punch openings 170 in the die shoe have diameters equal to the flared outer portions of the bores in the matrix bushings. Counterbores 174 at the inner surface of the die shoe receive hardened inserts 176 to help spread the loads transmitted from the matrix bushings during punching.

I-shaped shear openings 178 and 180 are located medially in the die matrixes and die shoe respectively in alignment with shears 132. The inner portions of the shear openings 178 in the die matrixes are configured to receive the shears. The outer portions of the shear openings 178, and the shear openings 180 in the die shoe, are dimensioned slightly larger to facilitate ejection of the sheared slugs. Rectangular openings 182 are located in the bolster plate in alignment with the punch openings 170 and shear openings 180 to allow passage of the slug from the press.

Referring to FIG. 11, preferably one set of punches 134a and 136a, punch bores and matrix bushings are smaller than the other set to allow punching smaller diameter cross pin holes.

Guide rods 184 extend from joinder at each corner of the die shoe 140 through integral bushings 186 located in the top shoe 64 to guide and align the upper dies relative to the lower dies.

THE GRIPPING MEANS

Gripping means 187 comprising upper V guide assemblies 188 and lower V guide assemblies 190 are mounted in the die assembly to grip the tubing during forming of the webs. Both an upper and lower V guide assembly is located at each end of each upper and lower die respectively.

The lower V guide assemblies comprise bottom guide blocks 192 which are attached to the die shoe by means of bolts 194. Vertical bores 196 are located medially in the bottom guide blocks, as best shown in FIGS. 9, 10, 11 and 15. Horizontal semicircular notches 198 are located in the bottom guide blocks and are positioned to intersect the vertical axes of bores 196.

V guide tubes 200 are journaled within vertical bores 202 which are located in the die shoe in alignment with bores 196 but having larger diameters. Radial shoulders 204 having diameters configured to allow sliding fits within bores 202 are located on the bottoms of the V guide tubes 200. Compression springs 206 are located in medial bores 208 extending partially through the V guide tubes 200.

Vertical grooves 210 are located on the outer surfaces of the V guide tubes and are configured for sliding contact with the ends of bolts 212 which are mounted on the guide blocks thus preventing rotation of the V guide tubes. V shaped grooves 214 are formed in the inner surfaces of the V guide tubes in a manner to be in longitudinal alignment with the notches 198 when bolts 212 are in registry with grooves 210.

The upper V guide assemblies 188 include top guide blocks 216 which are mounted on the top shoe by means of bolts 218. The upper guide blocks comprise rectangular blocks having medial bores 220 located therein. Caps 221 are attached to the guide blocks by means of bolts 225 to contain the assemblies therein.

The remainder of the upper V guide assemblies is the same as the lower V guide assemblies comprising V guide tubes 200, having radial shoulders 204 configured for sliding engagement with bores 220, internal bores 208 containing springs 206, and V shaped grooves 214 located on their top surfaces. Bolts 212 register with grooves 210 in the V guide tubes aligning them with the tubing.

The indexing means 54 is attached to the die head by means of index bar 222 which is attached to the die shoe by means of two of the bottom guide blocks 192. Pin 223 fixes the longitudinal orientation of the index bar relative to the die head.

THE INDEXING MEANS

Referring to FIGS. 16 and 17, the indexing means 54 includes an anchor block 224 which is positioned longitudinally relative to the index bar 222 by means of a pin 226. The upper end of the pin registers with bore 228 in the anchor block and the lower end of the pin registers with one of a series of holes 230 formed in the index bar. The anchor block is retained further by means of a bottom plate 232 which is attached by bolts 234. Alignment shoe 236 is positioned within recess 238 formed by a downward extension of the anchor block and the index bar. The alignment shoe is retained centrally by means of a bolt 240 and is caused to bear adjustably against the edge of the index bar by means of alignment bolts 242. Mounted within a recess 244 formed within the opposite side of the anchor block is clamping shoe 246 which is caused to bear against one edge of the index bar by means of a clamp bolt 248.

Positioned forwardly adjacent the anchor block is index block 250 which engages the index bar adjustably in a similar fashion as the anchor block. Accordingly, plate 252 is attached to the bottom face of the index block by bolts 254. An alignment shoe (not shown) is retained centrally by bolt 256 and adjusted by paired alignment bolts 258. On the opposite side of the index block 250 is a recess 260 retaining clamping shoe 262 which is caused to bear against one edge of the index bar by means of clamping bolt 264.

Aligned with the longitudinal centerline of the index bar 222 and integral with the index block 250 is a vertically positioned ear 266 having a threaded bore 268 in its upper portion configured to receive one end of a threaded index rod 270. Shoulder 272 is located at the other end of the threaded index rod and a reduced diameter integral shaft 274 extends therefrom. The shaft fits within a bore 276 which is located in a vertically disposed transverse ear 278 integral with and formed on the top of the anchor block 224. The end of the shaft 274 is configured to engage bore 280 located in a micrometer knob 282.

Mounted within slot 284 formed into the top surface of the ear 278 by screw 286 is one end of an elongate scale 288. The opposite end of the scale registers with a slot 290 located in the top surface of the ear 266.

Index block 250 extends outwardly to form ears 292 and 294 at its forward end. Located on the top surface of these ears are vertically disposed stop blocks 296 and 298. Top rotational stops 300 are mounted adjustably to the stop blocks by means of bolts 302 which pass through vertical slots 304 located in the stop blocks. The outer portions of the stop blocks angle outwardly to form side deflectors 306.

OPERATION

The manner of use of the herein described apparatus is as follows:

With the sequencing die in the open tube receiving position shown in FIG. 9, the tubing 52 is inserted into one set of dies 56 and 60 from the left hand end. The tubing is inserted a sufficient distance to extend past the right hand gripping means. It will be noted that the tubing is supported completely by the lower V guide assemblies and is separated a small distance from the die matrix 144.

Figure 19:
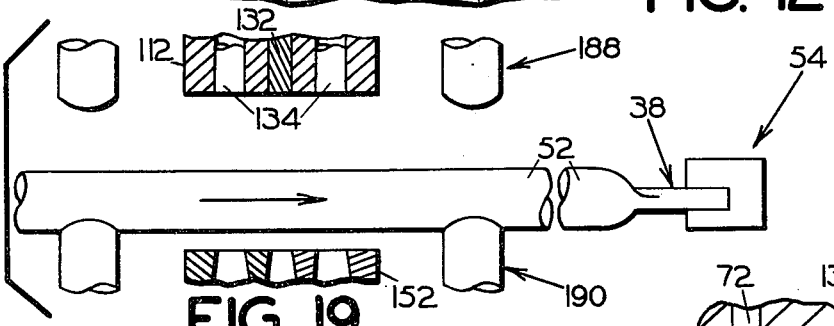
FIGS. 19–22 are diagrammatic, cross sectional views taken along the same line as FIGS. 9 and 10 and illustrating the sequential steps of operation of the apparatus.
Figure 6:
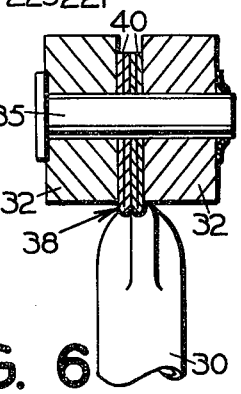
FIG. 6 is a further enlarged, fragmentary, cross sectional view taken along line 6—6 of FIG. 1.

The sequence of the forming operation of the present invention is illustrated diagrammatically in FIGS. 19–22. FIG. 19 disregarding the foreshortened rightmost portion of tubing shows the sequencing die prior to activation of the press. Pressurized hydraulic fluid from external hydraulic means (not shown) is introduced into passgeway 110 to position the punches and shear in their flattening positions, as shown in FIG. 9.

After the tube is positioned and the hydraulic pressure applied, the press is activated by appropriate controls (not shown). Ram 58 causes stamping head 112 to squeeze the tubing against die matrix 144 to form the flattened end portion 40 of the web, as shown in FIG. 20.

It will be noted that the pressure of the hydraulic fluid may be set at an appropriate level to prevent reduction in the size of passageway 110, thereby limiting extension of the shear and punches beyond their flattening positions until flattening is finished completely.

Figure 20:
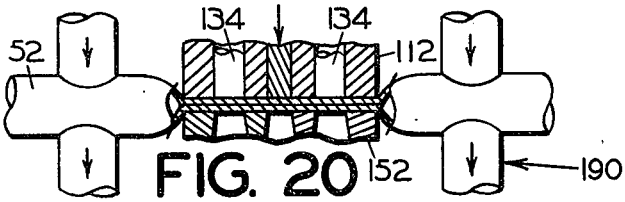

It also will be noted by the arrows in FIG. 20 that the upper and lower V guide tubes are allowed to move in the direction of flattening during the flattening sequence. Thus by proper selection of springs 206, the entire length of tubing will be displaced laterally i.e. vertically in the embodiment illustrated, during the flattening operation for locating the flattened end portions in alignment with the longitudinal center line of the tubing.

In addition, during the flattening operation, those portions of the tubing adjacent dies 126 and 160 located in recesses 122 and 156 are not flattened completely thereby forming the semi-flattened triangular portions 48 between lines 46 and 49, FIG. 2.

Figure 27:
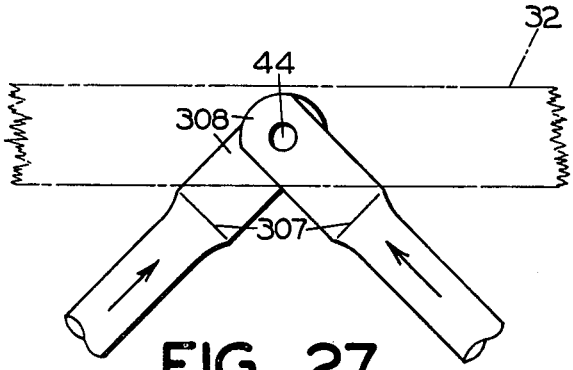
FIG. 27 is a fragmentary view in elevation similar to FIG. 5 showing a typical joint utilizing the webs formed by the prior art apparatus.

Referring to FIG. 27, the prior art apparatus form completely flattened web ends having normal margins 307. As a result, when the web bears a compressive load, those flattened portions which are unsupported by the chords are subject to bending.

Figure 21:
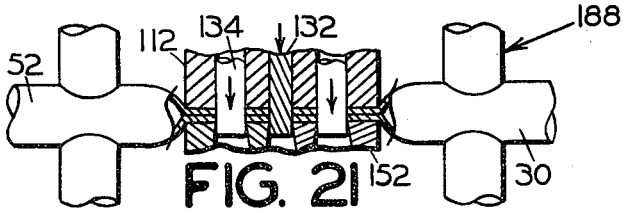

When the web ends are flattened completely, further movement of the ram compresses the hydraulic fluid to a pressure where the pressure regulation means (not shown) associated with the hydraulic means allows the hydraulic fluid to be forced out of passageway 110. The size of the passageway is decreased, causing the shear and punches to be moved to their punching positions, as shown in FIGS. 10 and 21. Thus the terminal portions of the web ends 42 and the cross pin holes 44 are formed.

Figure 24:
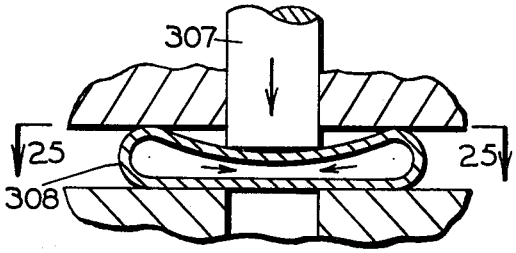
FIG. 24 is a diagrammatic, fragmentary, lateral cross sectional view illustrating for purposes of comparison a portion of prior art apparatus.
Figure 26:
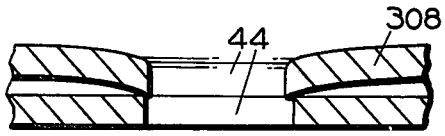
FIG. 26 is a fragmentary, cross sectional view taken along the line 26—26 of FIG. 25.
Figure 25:
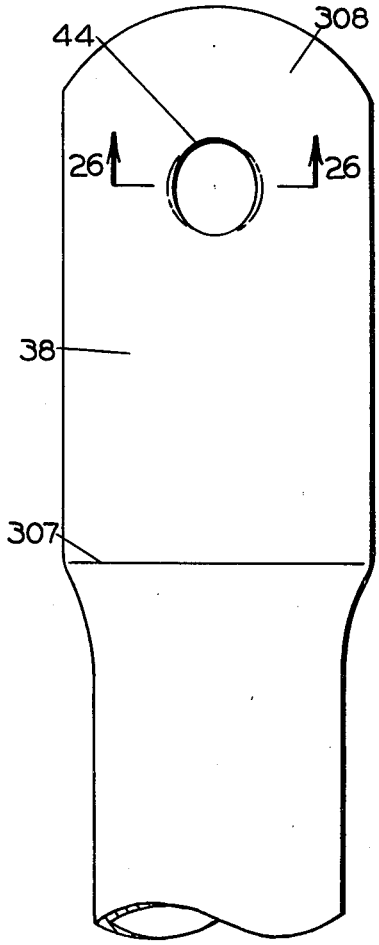
FIG. 25 is a fragmentary view in plan taken along line 25—25 of FIG. 24 with part of the elements omitted.

Referring to FIG. 24 the prior art apparatus initiate punching of the cross pin receiving holes by punch 307 before flattening of the end portion 308 is completed. Thus as shown in FIGS. 25 and 26, the holes are misformed. As a result, they pinch the punch during stripping, and cause extensive punch wear, and form holes which are elliptical and inaccurately located resulting in inconsistent webs. In addition because the punching is prematurely initiated, complete flattening is never obtained.

Figure 22:
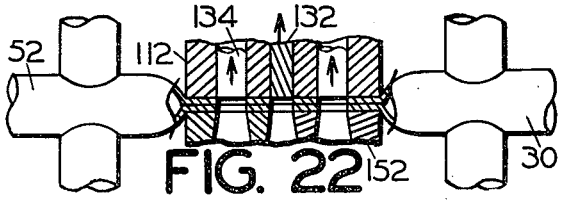

The press then is opened, first retracting the punches and shear, as shown in FIG. 22, and then opening the die assembly to its open position, as shown in FIG. 9.

The right hand piece of tubing may be removed from the sequencing die and discarded. The tubing then is moved further to the right to complete the forming sequence. The just-formed web end is positioned in the indexing means, as shown in FIG. 19, to set the length of the web.

Before receiving the web end the indexing means 54 must first be adjusted as follows to allow forming a web of a desired length.

First, scale 288 is adjusted to the position shown in FIG. 17 by rotating micrometer knob 282. The index pin 226 is inserted into the index bar hole 230 that will cause the indexing means to be just long of giving a web of the desired length. The micrometer knob then is rotated causing the indexing block 250 to be moved the appropriate distance as indicated on the scale and micrometer markings 310.

The appropriate top rotational stop 300 is adjusted to a selected dimension above the index block 250. The tubing then may be rotated clockwise a predetermined amount by positioning the web end relative to the top rotational stop, as shown in FIG. 18. Thus the effect of anticlockwise twisting the tube about its longitudinal axis is compensated for when the opposite web end is formed.

The press is activated again to form the web end at the opposite end of the web. It will be noted that the indexing means allows forming a web of accurate overall length. In addition the precision die stamping operation allows punching the cross pin holes and shearing the terminal portions with uniform accuracy relative to one another. Therefore, the cross pin holes are separated accurately providing a uniform web and resulting in close dimensional control of chord separation.

When the second web end is formed, as just described, another first web end is formed simultaneously at the end of the tubing. Therefore, upon each subsequent activation of the press after the first, a completed web is formed along with a web end.

Referring to FIG. 1, often it is desirable to use webs of different diameters and having different size cross pin holes. To form a small web 30*a* the other set of dies having the smaller diameter punches 134*a* may be utilized to form a smaller hole 312. In this event a transition web 30*b*, having a large diameter cross pin hole 44 at one end and a small diameter cross pin hole 312 at the other (FIG. 2) is required between the smaller web 30*a* and the normal web 30. This may be formed by forming one end in one set of dies and the other end in the other set of dies.

The foregoing description of the operation of the sequencing die of the present invention covers the normal sequence. However, it is not meant to be comprehensive and other operational sequences may be utilized to form webs of different configurations.

Having thus described my invention in a preferred embodiment, I claim:

1. A method for forming truss joist webs with longitudinally opposed web ends from tubing comprising:

a. providing a length of tubing,
b. flattening the end portion of the tubing to form one of the flattened web ends, and
c. punching and shearing the flattened end portion without further flattening for forming a cross pin receiving hole and a terminal end portion,
d. advancing the tubing,
e. flattening the opposed end portion of the tubing for forming the opposed flattened web end, and
f. punching and shearing the opposed flattened end portion without further flattening for forming a cross pin receiving hole and a terminal end portion.

2. A method for forming truss joist webs with longitudinally opposed web ends from tubing, comprising:

a. providing a continuous length of tubing,
b. flattening the end of the tubing forming a flattened end portion of a first web,
c. punching and shearing the flattened end portion for forming a cross pin receiving hole and a terminal end portion,
d. advancing the tubing,
e. flattening the tubing again for simultaneously forming the opposed flattened end portion of the first web and a flattened end portion of a second web, and
f. punching and shearing the just formed flattened end portions without further flattening for separating the first and second webs and forming cross pin receiving holes and terminal end portions in each flattened end portion.

3. A sequencing die operable by a mechanical press for forming truss joist webs from metal tubing and including first flattening means for flattening longitudinally opposed web ends in the tubing, punching and shearing means for punching cross pin receiving holes in the web ends and shearing a terminal portion of the web ends without further flattening, and second flattening means configured for forming a partially flattened portion inwardly of a terminal end of the flattened end portion and cooperating with the latter to provide a diagonal edge for abutment by a truss joist chord.

4. A sequencing die operable by a mechanical press for forming truss joist webs from metal tubing, having flattening, punching and shearing means for sequentially flattening longitudinally opposed web ends in the tubing and then punching cross pin receiving holes in the web ends and shearing the terminal portion of the web ends without further flattening, the die including gripping means located on the press outwardly adjacent the flattening means and configured for movement relative to the flattening means during forming of the webs for allowing lateral displacement of the tubing for aligning the web ends with the longitudinal center line of the tubing.

5. A sequencing die operable by a mechanical press for forming, from tubing, truss joist webs having longitudinally opposed web ends, the die comprising;

a. flattening means operably engaged by the press and configured for flattening the end portion of the tubing, b. punching and shearing means located in and movable relative to the flattening means for punching a cross pin receiving hole in and shearing the terminal portion of the flattened end portion without further flattening of the tubing, and c. means for operating the punching and shearing means for effecting said punching and shearing only after the flattening means has been operated to flatten the end portion of the tubing.

6. The sequencing die of claim 5 wherein the flattening means and the punching and shearing means are arranged in a manner to engage tubing intermediate its ends for simultaneously forming two opposed web ends on different webs.

7. The sequencing die of claim 5 wherein the flattening means includes dies configured for forming a partially flattened portion inwardly of the terminal end of the flattened end portion and cooperating with the latter to provide a diagonal edge for abutment by a truss joist chord.

8. The sequencing die of claim 5 including indexing means configured for receiving a first web end releasably and indexing it relative to the flattening means for allowing forming of the opposed web end a dimensionally accurate distance from the first web end, the indexing means containing anti-twisting means for preventing twisting of the tubing about its longitudinal axis during forming of the web for radially aligning the web ends with each other.

9. The sequencing die of claim 5 including gripping means located on the press outwardly adjacent the flattening means for gripping the tubing, and configured for movement relative to the flattening means during forming of the webs for allowing lateral displacement of the tubing for aligning the web ends with the longitudinal center line of the tubing.

* * * * *